United States Patent [19]

Brown

[11] 3,975,009

[45] Aug. 17, 1976

[54] MACHINE FOR FOLDING FLEXIBLE SHEETS

[76] Inventor: Frank H. Brown, R.D. No. 1, Norwich, N.Y. 13815

[22] Filed: Dec. 23, 1974

[21] Appl. No.: 535,357

[52] U.S. Cl. ..... 270/68 A

[51] Int. Cl.[2] ..... B65H 45/14

[58] Field of Search ..... 270/68 R, 68 A, 79, 270/61 F

[56] References Cited

UNITED STATES PATENTS

| | | | |
|---|---|---|---|
| 2,389,458 | 11/1945 | Preston | 270/80 |
| 3,211,448 | 10/1965 | Stoothoff | 270/68 A |
| 3,712,610 | 1/1973 | Garrone | 270/79 |

*Primary Examiner*—Edgar S. Burr
*Assistant Examiner*—A. Heinz
*Attorney, Agent, or Firm*—Shoemaker and Mattare, Ltd.

[57] ABSTRACT

A machine for folding flexible sheets, such as paper, and more particularly blueprints and the like, comprises a plurality of fold stations, each including a pair of pinch rolls and a deflector selectively operable to cause a sheet of material fed to the machine to be fed between a pair of pinch rolls and thus folded, or to be fed past the pinch rolls and not folded, an infeed tray to feed a sheet of material to the fold stations, a plurality of first sensing devices on the infeed tray spaced apart in the direction of travel of the sheet to sense the presence of a sheet of material on the infeed tray, and a sensing device at each fold station to sense the presence of a sheet being folded at that station, said sensing devices operatively connected with the deflectors to operate the deflectors to cause the sheet of material to be folded at the next succeeding fold station only when the sheet of material is sensed simultaneously by the spaced sensing devices on the infeed tray and the sensing device at the next preceding folding station.

15 Claims, 32 Drawing Figures

F
52
64
66
C
82
51
84
74
68
83
79
90
93
98
97
S1
100
99
94
S2
91
87
S3
86
S4
6
S5
S6
53
56
39
40
58
75
95
96
59
57
67
63
65
S

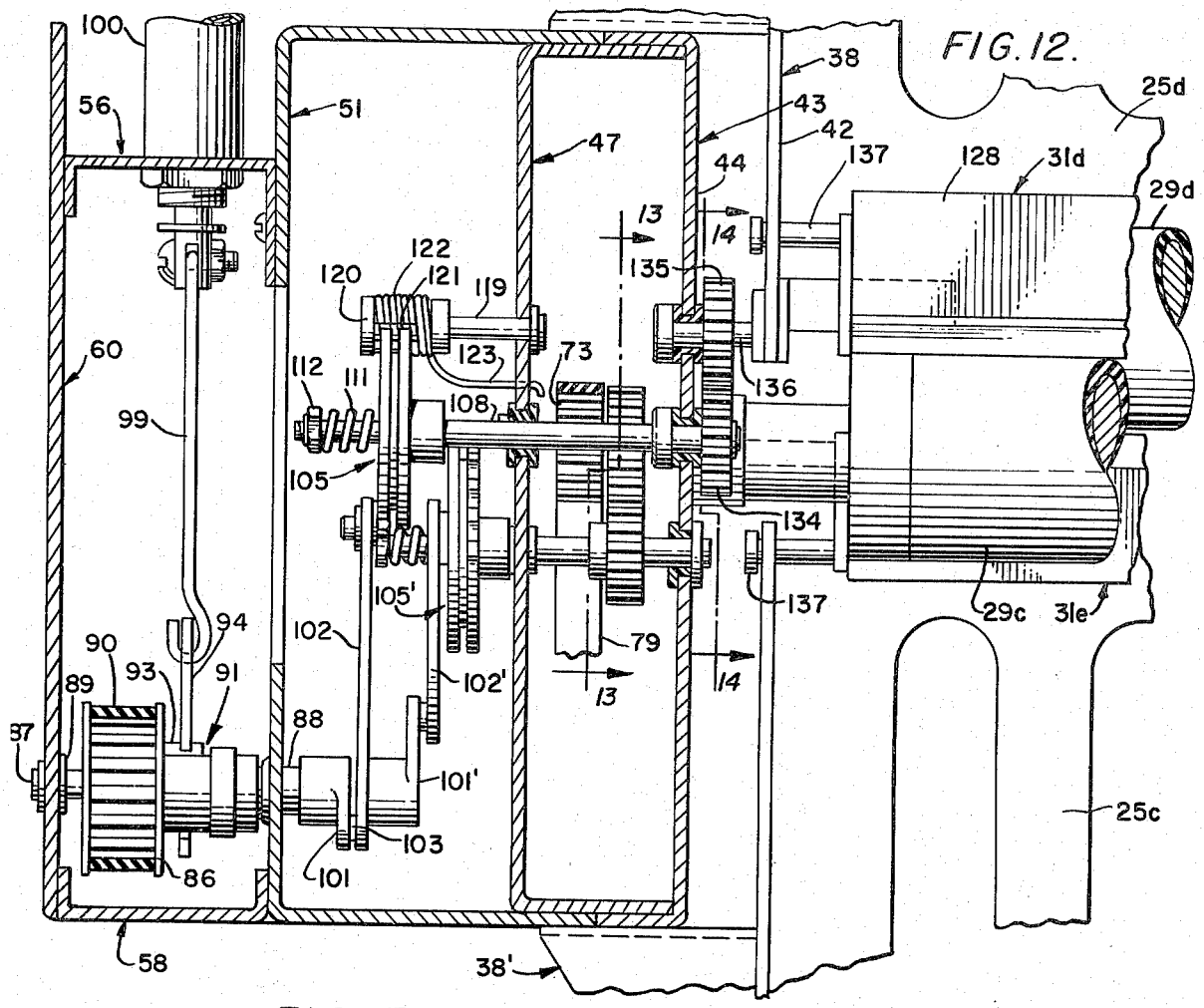
FIG. 13.
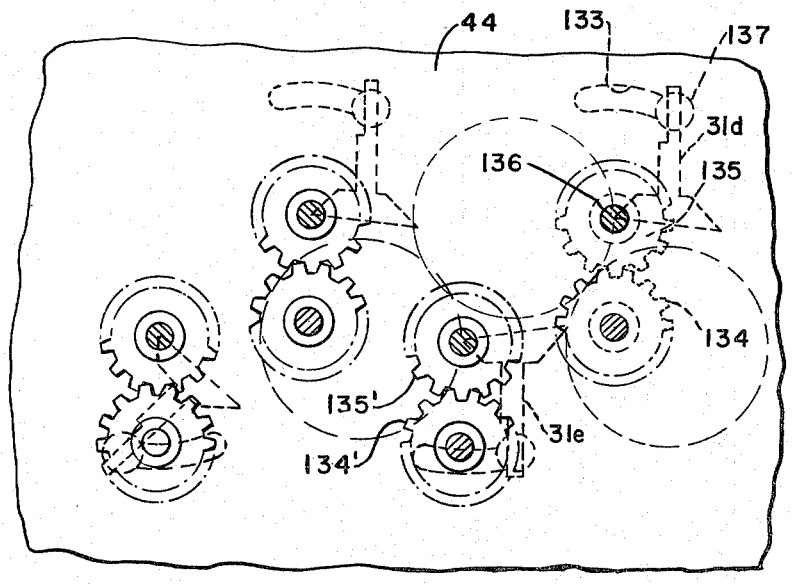
FIG. 14.
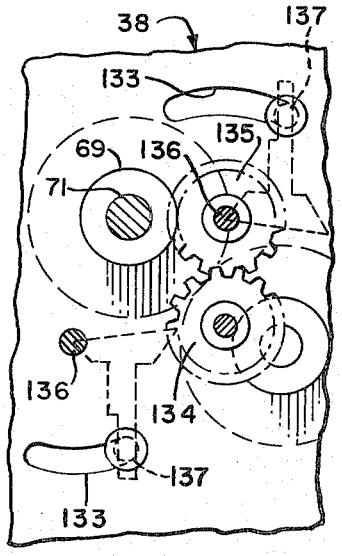

+10
110V 60~
LN1
LN2
LN3
LN4
LN5
LN6
CD4001
CD4010
BUFFER AMP.
.0012
C1
PS
Q7
Q8
Q9
Q10
Q11
2N4401
2N2647
1A100V
3A100V
SID
SCR1
SCR2
SCR3
SCR4
SCR5
SCR6
+24

MACHINE FOR FOLDING FLEXIBLE SHEETS

BACKGROUND OF THE INVENTION

This invention relates to a machine for folding flexible sheets of material, and more particularly, to a buckle folding machine for folding paper, such as blueprints and the like.

The machine of the invention automatically folds sheets of various sizes to a predetermined standard size. The machine of the invention does not require the manual manipulation of any separate control devices in order to set the machine to fold a sheet of predetermined size to a standardized folded size, and instead, the machine of the invention utilizes sensing devices which sense the size of the sheet fed to the machine and automatically effect operation of folding means to fold the sheet the required number of times to reduce it to the standardized size, dependent upon the size of the sheet as sensed by the sensing devices.

Further, the machine of the invention includes deflector means operative between one position to effect folding of the sheet and a second position to effect the feeding of the sheet through the machine unfolded, and an operating means for the deflector means includes a slip clutch or other suitable power transmission means therein, whereby if movement of the deflector means is prevented for any reason, such as jamming of the sheet of material or the like, then the slip clutch or other means enables operation of the power means without causing damage to the deflector means or operating means or other portions of the machine.

Moreover, the operating means includes a spring clutch means or sprague clutch or other similar means therein and a holding means operatively connected therewith, whereby the power means is continuously operated and the holding means is operated in response to the sensing means to release the spring clutch or the like and thereby determines or controls the synchronization of the deflector means of the invention.

Thus, the speed of operation of the machine is greatly increased, as well as the reliability thereof.

None of the prior art machines for folding flexible sheets of material include any sensing means comparable to that of the present invention, which are operative to automatically effect folding of various sizes of sheets of material to a predetermined standard size. Further, the prior art folding machines do not suggest the unique slip clutch and spring clutch mechanisms, or similar devices, in the operating means for the deflectors. Accordingly, the prior art machines either require a plurality of push buttons or other means to be manipulated in order to preset the machine for each of a plurality of different sizes of sheets so that the sheet is folded to a predetermined standard size, or various other adjustments must be made to the machine each time a different size sheet is fed thereto to be folded to a standard size. Moreover, the prior art machines are not capable of operating with the speed and efficiency of the present invention.

OBJECTS OF THE INVENTION

Accordingly, an object of this invention is to provide a machine for folding flexible sheets of material, wherein sensing means are provided on the machine arranged to automatically effect a required number of folds in a flexible sheet of material to reduce it to a standard size, regardless of the initial unfolded size of the sheet of material.

Another object of the invention is to provide a machine for folding flexible sheets of material wherein a plurality of fold stations are provided and a deflector means is at each fold station operable to a first position to effect folding of a sheet of material and to a second position to effect bypassing of the fold station, said deflector means being operated by a means including a slip clutch or similar device, whereby in the event operation of the deflector means is hindered or blocked, such as by the material becoming jammed or the like, the power means is enabled to continue operating without damage to the operating means or deflector means or other parts of the machine.

A further object of the invention is to provide a machine for folding flexible sheets of material wherein a plurality of fold stations are provided and a deflector means is at each fold station operative to two positions to either effect folding of the sheet of material or bypassing of the sheet of material, respectively, and wherein the operating means for the deflector means includes a spring clutch means and a holding means operatively associated therewith, whereby the power means for the deflector means is continuously operated and the holding means operated in response to a sensed condition to effect synchronization of the deflector means, thereby substantially increasing the speed and reliability of operation of the machine.

BRIEF DESCRIPTION OF THE DRAWINGS

FIG. 4 is a view similar to FIG. 3 showing the deflector means in the other of its two positions.

FIG. **4*a*** is a fragmentary view of the slip clutch means showing it in an intermediate position.

Figure 5:
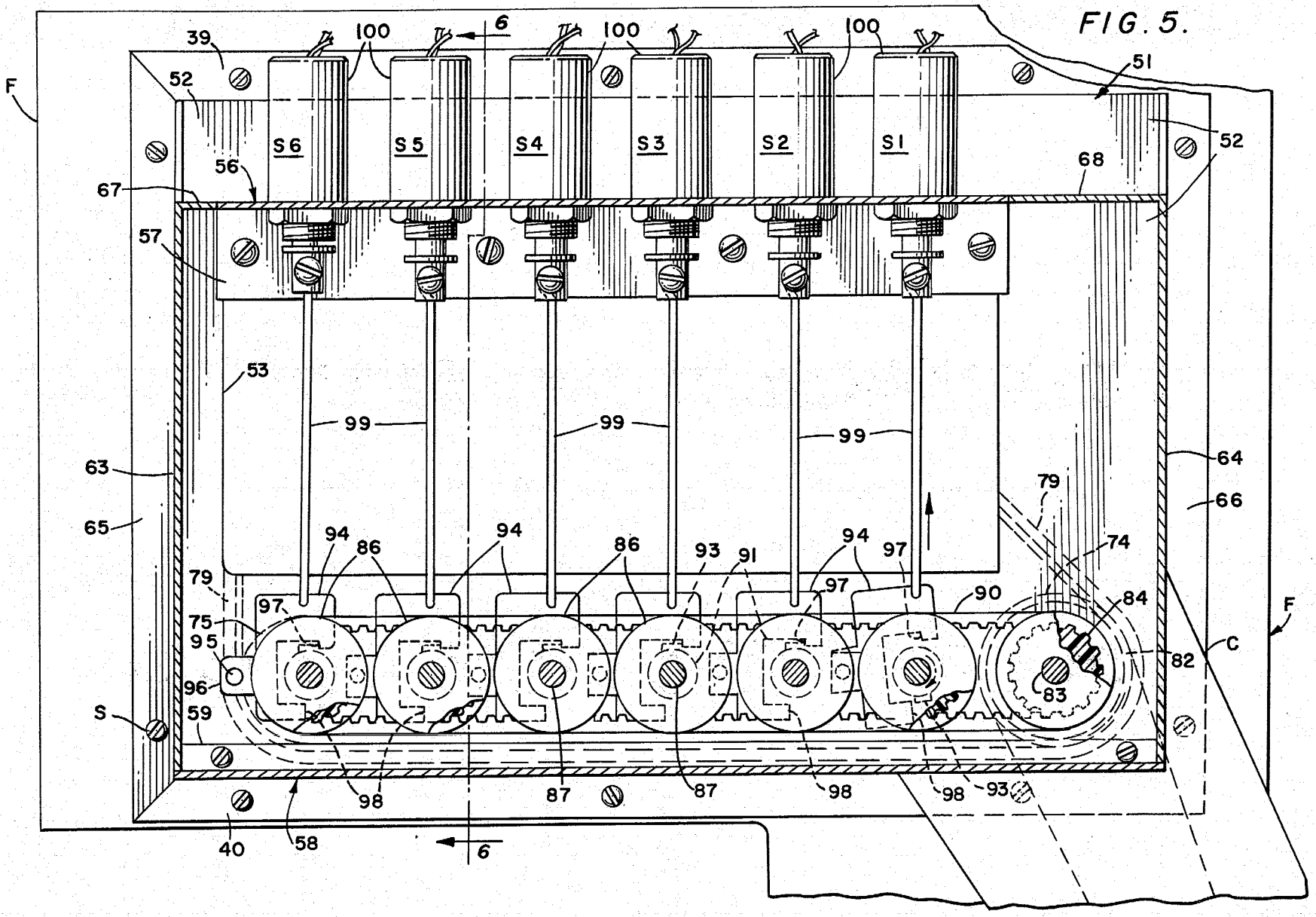
Figure 6:
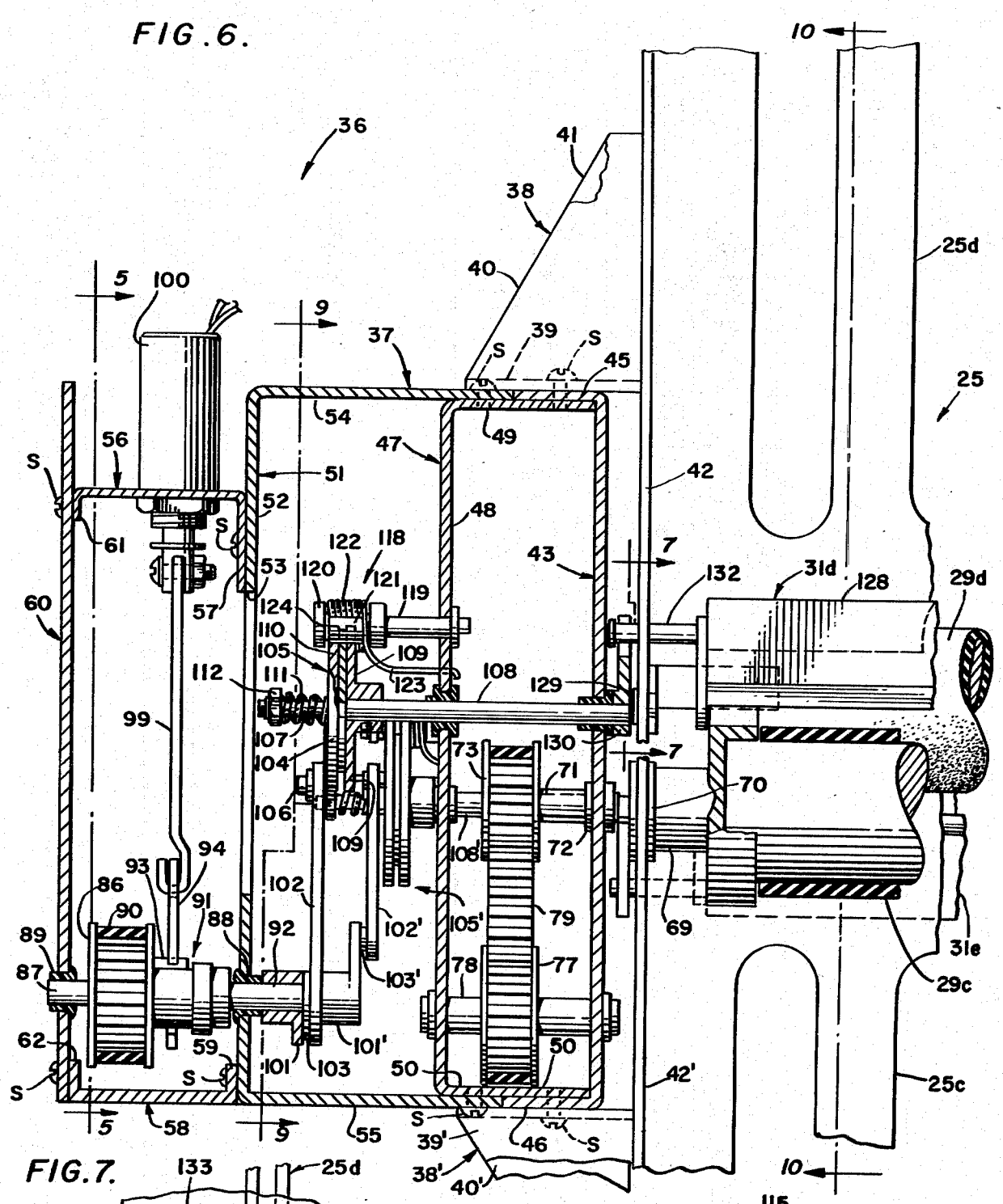

FIG. 5 is a greatly enlarged sectional view taken on line 5—5 of FIG. 6 showing a portion of the operating mechanism for the machine of the invention, and particularly the holding means and spring clutch means with a portion of the power means for the deflectors.

FIG. 6 is a greatly enlarged fragmentary sectional view taken along line 6—6 in FIG. 5.

Figure 7:
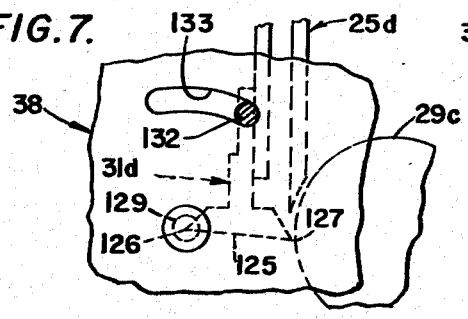

FIG. 7 is an enlarged fragmentary view taken along line 7—7 in FIG. 6.

Figure 8:
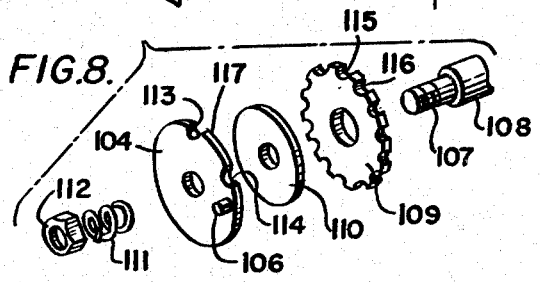

FIG. 8 is an exploded perspective view of the slip clutch.

Figure 9:
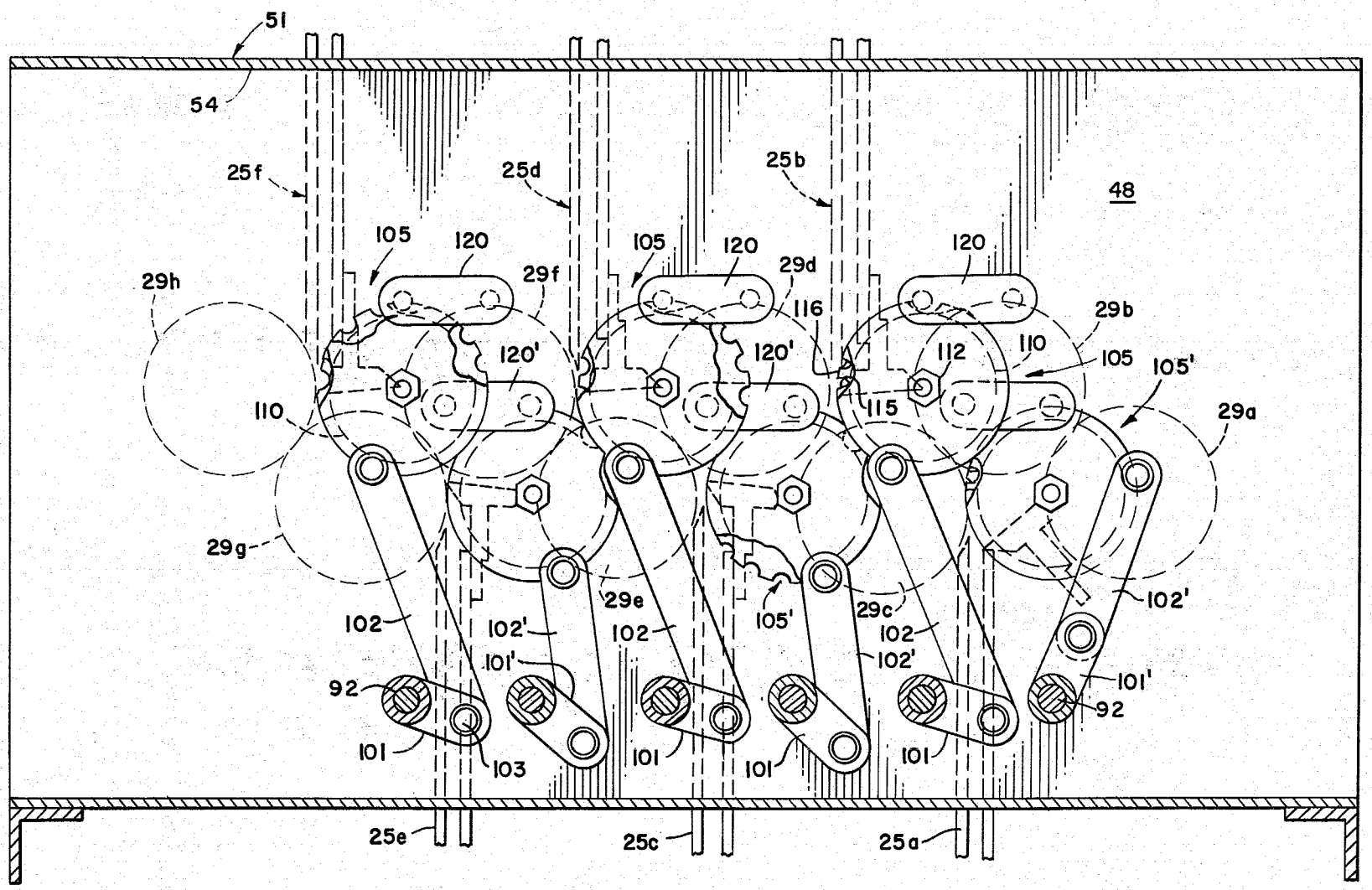

FIG. 9 is an enlarged view in section taken along line 9—9 in FIG. 6.

Figure 10:
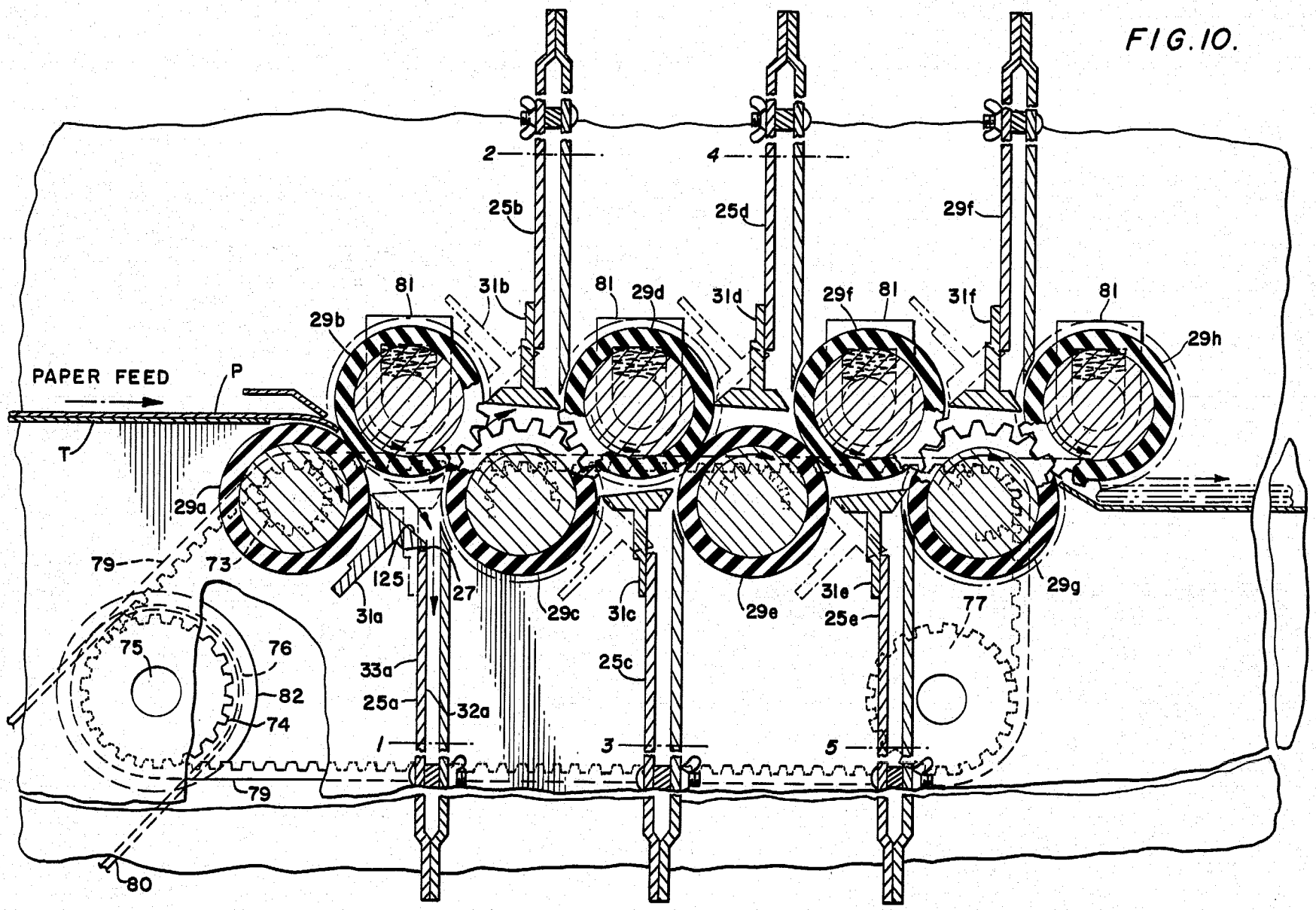

FIG. 10 is an enlarged view in section taken along line 10—10 in FIG. 6.

FIGS. 11A–11L are schematic views of the fold stations and sensing means of the invention, showing the various stages of operation for folding a sheet of material.

FIG. 12 is a view in section similar to FIG. 6, showing a modification of the operating means for the deflectors.

FIG. 13 is a view in section taken along line 13—13 in FIG. 12.

FIG. 14 is a view in section taken along line 14—14 in FIG. 12.

Figure 15:
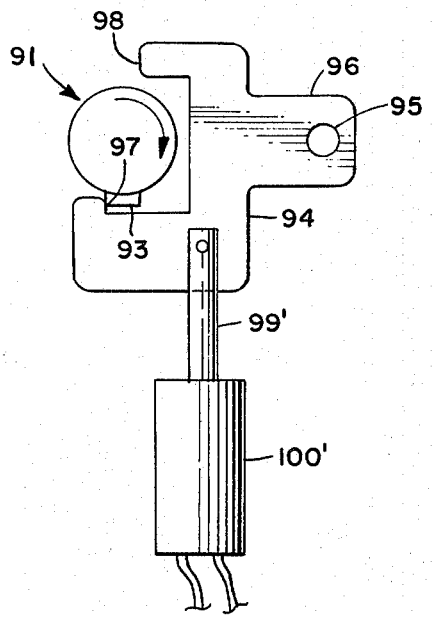

FIG. 15 is a fragmentary view in elevation of a portion of a modification of a holding means for the spring clutch means of FIG. 5.

Figure 16:
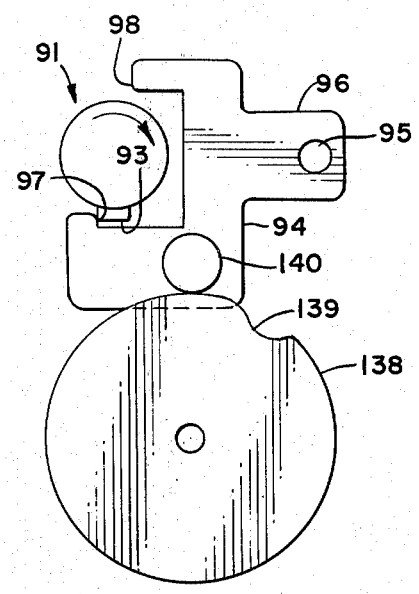

FIG. 16 is a fragmentary view in elevation of a portion of a further modification of a holding means for the spring clutch means of FIG. 5.

Figure 3:
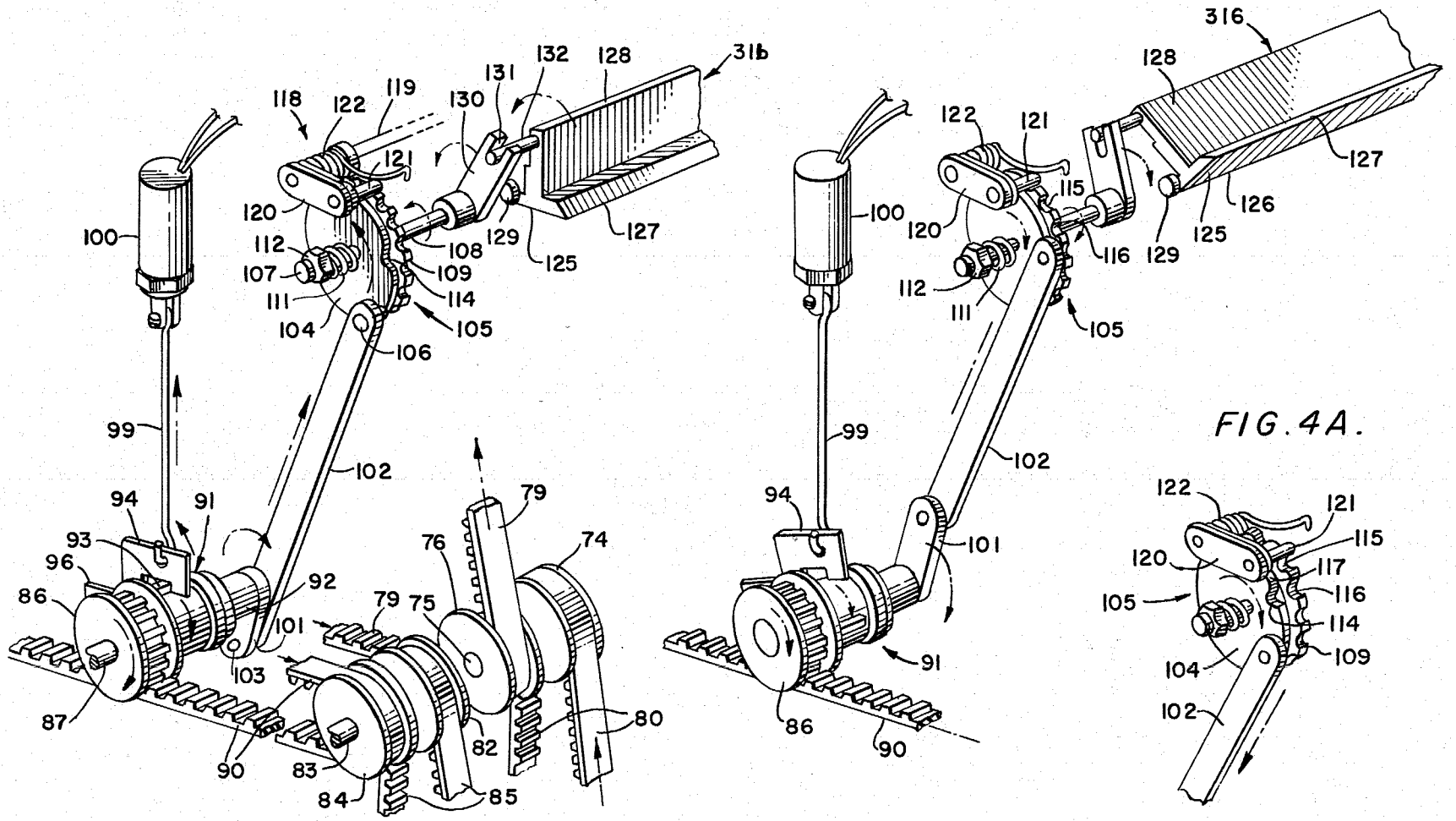
FIG. 3 is an enlarged perspective view of a portion of the operating mechanism for the deflector means in a preferred form of the invention and showing the deflector means in one of its two positions.
Figure 17:
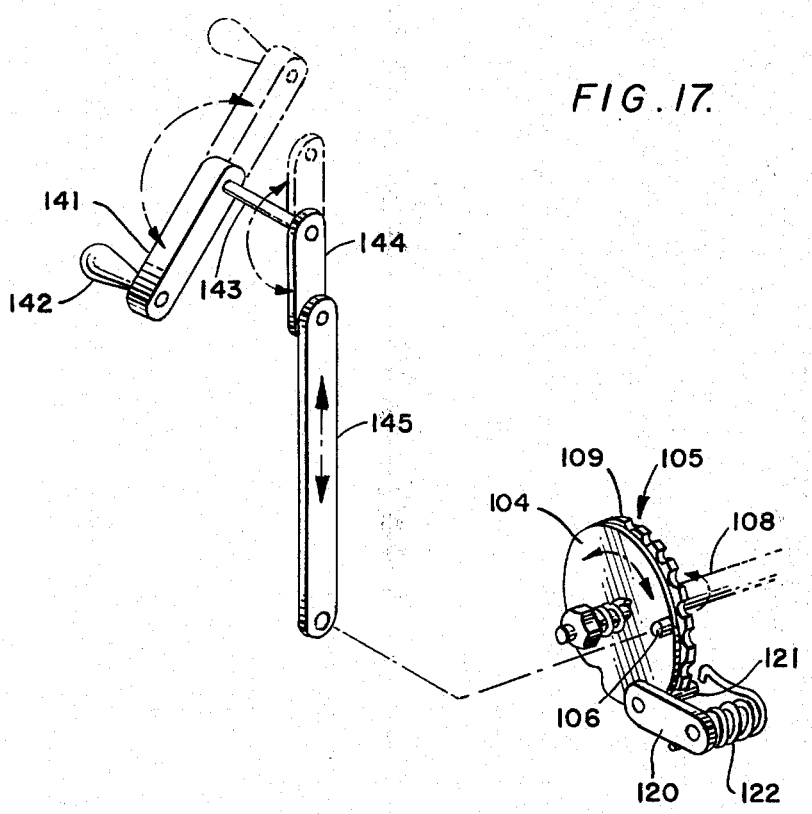

FIG. 17 is a view similar to FIG. 3 of a still further modification of operating means for the deflectors, wherein the operating means is manually operated.

Figures 18, 19:
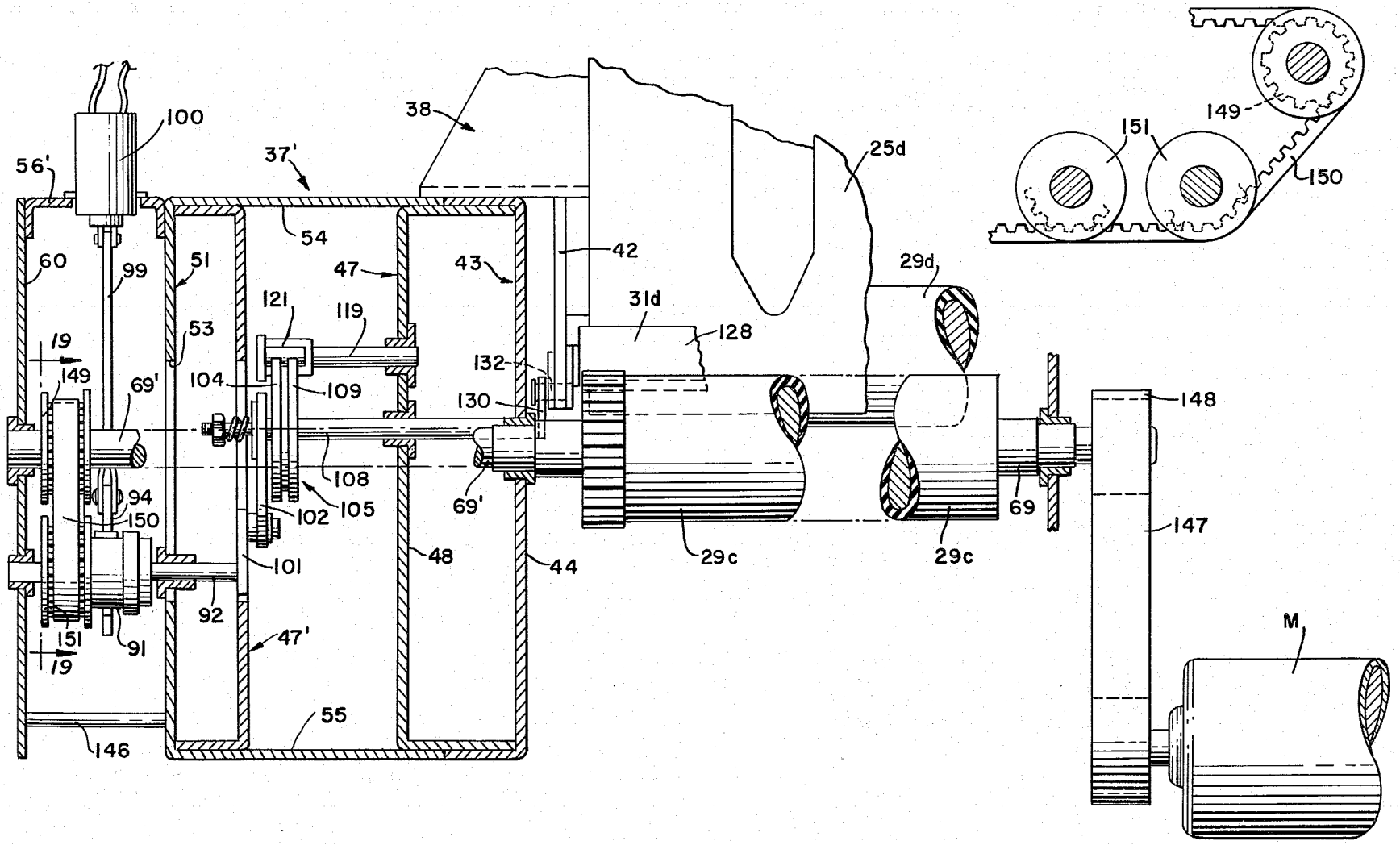

FIG. 18 is an enlarged, fragmentary, sectional view similar to FIG. 12, of a further modification of the drive means and operating means of the invention.

FIG. 19 is an enlarged, fragmentary view taken along line 19—19 in FIG. 18.

Figure 20:
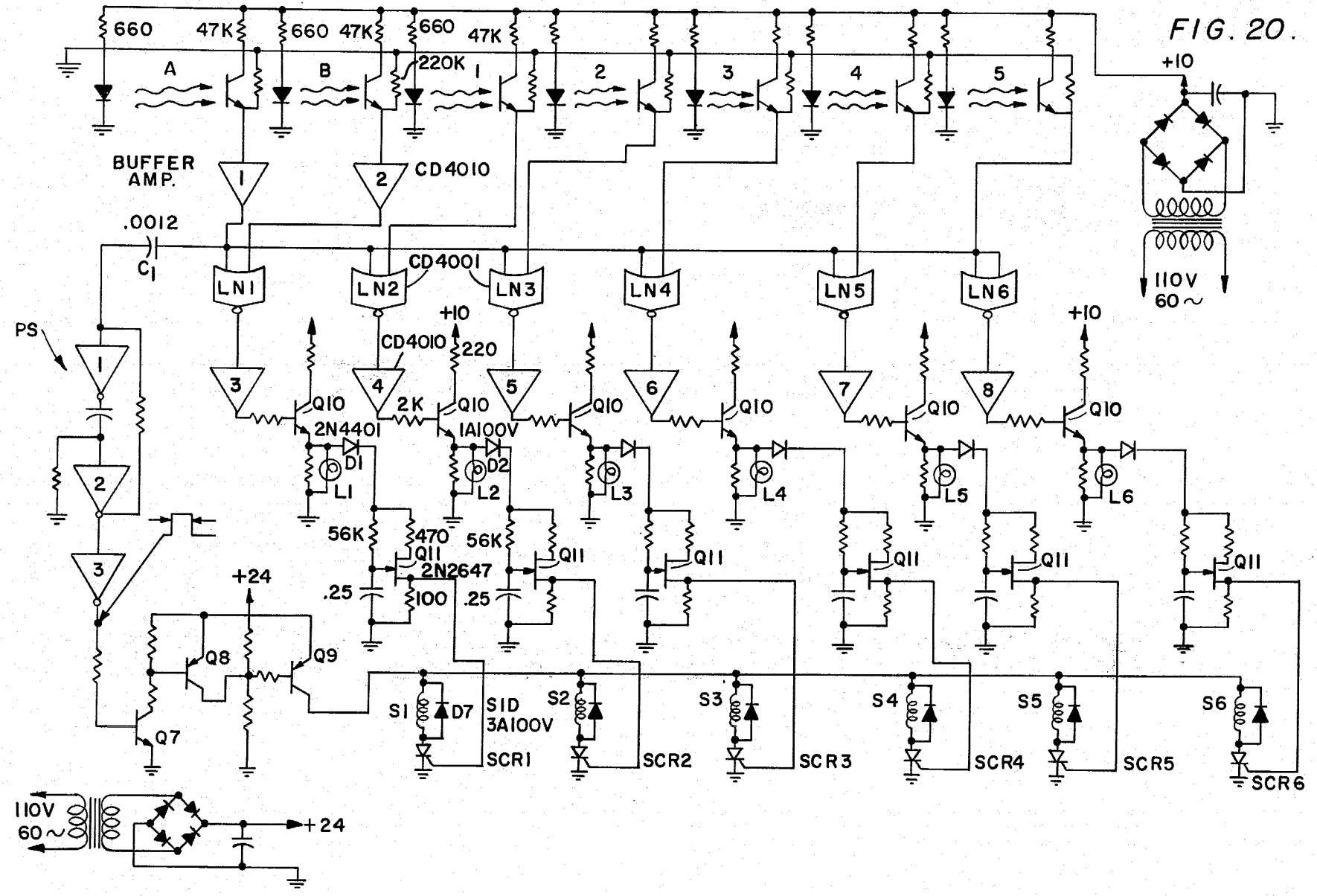

FIG. 20 is a schematic view of the electrical circuit for the machine of the present invention.

DETAILED DESCRIPTION OF THE INVENTION

Figure 1:
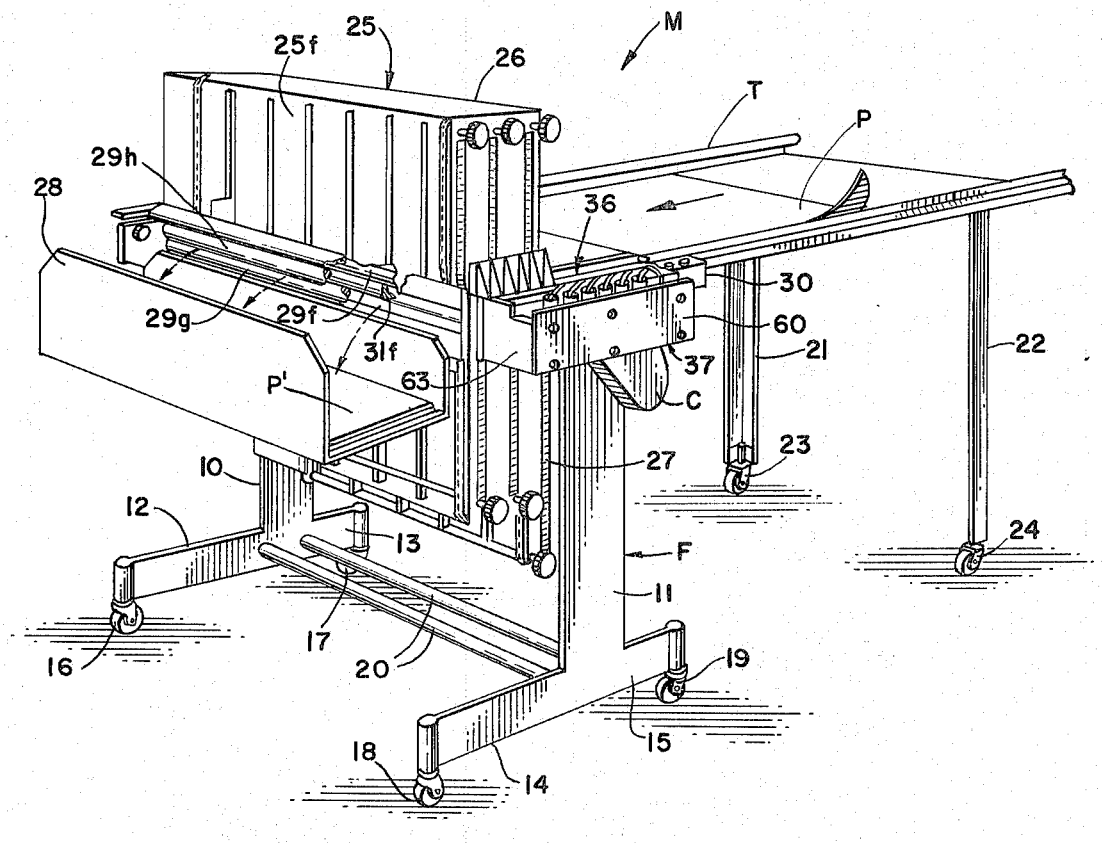
FIG. 1 is a top perspective view of a machine in accordance with the invention.

In FIG. 1 the machine in accordance with the invention is indicated generally at M and includes a base or support frame F comprising a pair of depending legs or supports 10 and 11, having oppositely directed lateral extensions 12, 13 and 14, 15, thereon, respectively. Caster means or the like 16, 17 and 18, 19 are carried by the outer ends of the extensions 12, 13 and 14, 15, respectively, for mobility of the machine M, and suitable brace means or the like 20 extend between the opposite legs 10 and 11 to brace the support frame F. An infeed means or tray or table T is connected to the machine at one side thereof and is supported at its outer end by means of a pair of legs 21 and 22, having casters or the like 23 and 24 on the lower ends thereof. A plurality of fold stations 25 comprising a series of upper fold stations 26 and a series of lower fold stations 27 are carried by the machine and are arranged to receive a sheet of paper or the like P from the infeed tray or table T and to fold the sheet and discharge it into a receptacle 28 on the opposite side of the fold stations from the infeed tray T. Suitable motor means (not shown) is supported on the frame F and is arranged to drive the rolls or rollers 29*a–h* through a suitable system of belts and pulleys or the like (not shown), preferably enclosed by a case or cover C.

The machine is turned on and off by a suitable switch, such as on-off switch or the like 30, supported on the frame in a convenient location. A plurality of deflector plates or gates 31*a–f* are arranged at the respective fold stations and are selectively operable to a first position to effect feeding of a sheet of paper or the like P into a respective space or fold pocket 32*a–f*, defined between pairs of spaced fold plates 33*a–f* and 34*a–f* at the respective fold stations.

Suitable stop means 35*a–f* are provided in association with the fold pockets 32*a–f* in the respective fold stations against which the leading edge of the paper abuts when fed into the respective pocket to effect buckling or folding of the paper adjacent the entrance to the fold pocket whereby the buckled or folded portion of the paper is fed between a succeeding pair of pinch rolls such as 29*b* and 29*c* to effect creasing or folding of the sheet of paper or the like.

The deflectors 31*a–f* are also operable to a second position to cause the sheet of paper or the like to be deflected or moved past the respective associated fold pockets and to be thus moved through the machine without being folded at that fold station.

Control means for operation of the deflectors 31*a–f* includes a pair of spaced sensing devices, such as photocells or photodiodes or LED's or the like, A and B on the infeed table or tray T spaced apart a predetermined distance D1, such as, for example, on the order of about 13 inches if the sheet is to be folded to a dimension of 11 inches, and further sensing devices, such as photocells or photodiodes or LED's or the like, 1, 2, 3, 4 and 5 are provided at the fold pockets 31*a–e* spaced from the entrance to the fold pocket a distance D2, which is preferably on the order of about 3 inches when the sheet is to be folded to a dimension of 11 inches.

The stops 35*a–f* are adjustably secured in position relative to the fold plates a distance D3 from the entrance to the fold pockets, which distance is 11 inches, for effecting an eleven inch fold in the sheet of paper or the like P.

Figure 2:
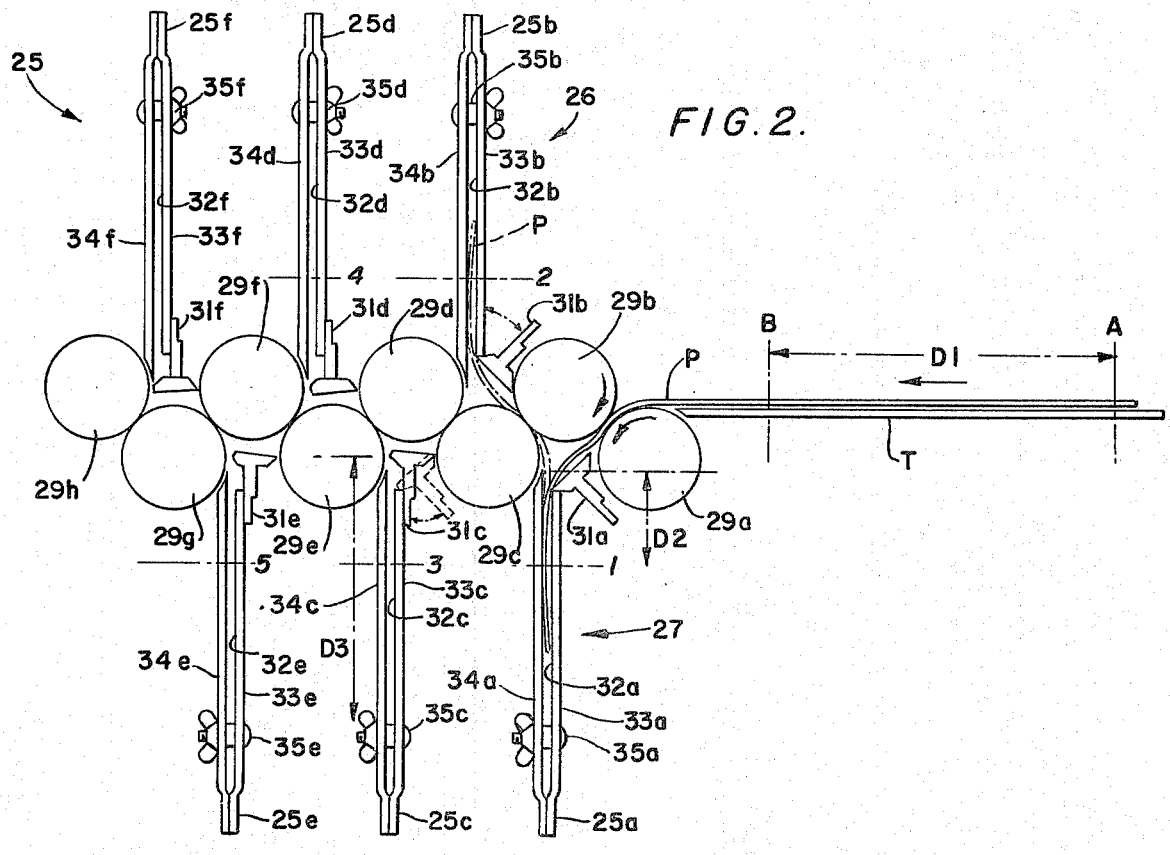
FIG. 2 is an enlarged schematic view of the infeed means and fold stations of the machine of the invention, showing the relationship of the various sensing means and deflectors relative to the fold stations and the operation thereof.

The photocells or other suitable sensing devices A, B and 1–5 are operatively connected through a suitable circuit with deflector operating means, to be later described, so that when a sheet of paper or the like P is placed on the table T and moved toward the first pair of rollers 29*a* and 29*b*, the first deflector 31*a* will be operated to the fold position, as seen in FIG. 2 for example, when the sheet P is sensed by both the sensing devices A and B on the infeed table T, or in other words, whenever the sheet has a dimension which exceeds the dimension D1. As the leading edge of the sheet enters the fold pocket 32*a* and is sensed by the photocell 1, the deflector 31*b* of the next succeeding fold station will be operated to the fold position if the sheet is still sensed by both of the sensing devices A and B on the infeed table, and each succeeding deflector 31*c*–31*f* will be successively operated to its fold position whenever the sheet of paper or the like P intersects the photocell at the preceding fold station and is also sensed by the devices A and B on the infeed table. When the trailing edge of the sheet moves past the sensing device A on the infeed table, then no more deflectors will be operated to the fold position, even though the leading edge of the sheet is sensed by the sensing device at one of the fold stations.

The operating means 36 for the deflectors is contained within a suitable housing 37, supported on the frame of the machine adjacent one side of the fold stations 25. A fold plate support bracket 38 is secured to the housing by means of screws S or the like extended through a bottom plate 39 of the bracket and into the housing 37. The bracket 38 has a pair of generally triangular shaped, upstanding braces 40 and 41 and a downwardly extending rear wall member 42, extending downwardly between the housing 37 and fold plates 25. A similar bracket 38' with braces 40' and 41' and upwardly extending rear wall member 42' is also secured in position below the rolls 29.

The housing 37 includes a cup-shaped rear wall member or partition 43 with a transverse rear wall 44 and forwardly extended ledges or flanges 45 and 46 at the upper and lower edges thereof, respectively, on which the brackets 38 and 38' are respectively secured by the screws S.

A substantially cup-shaped intermediate wall or partition 47 has a transverse intermediate wall 48 and upper and lower rearwardly extending flanges 49 and 50, nested within the forwardly extended flanges 45 and 46 of the rear wall member 43, and secured therein by screws or the like S.

A substantially cup-shaped front wall member 51 includes a transverse front wall 52 having a rectangular opening 53 substantially in the center thereof and rearwardly directed upper and lower ledges or walls 54 and 55 disposed in overlying relationship to ledges 49 and 50 of intermediate wall 47 and abutted in edgewise relationship against the forwardly extending ledges 45 and 46 on rear wall member 43. The front wall member 51 is secured in place by means of screws or the like S extended through the upper and lower walls or ledges 54 and 55 and into the ledges 49 and 50 of intermediate wall member 47.

An inverted, generally channel-shaped bracket 56 is secured to the front wall 52 by means of a plurality of screws or the like S extended through one downwardly extending side or flange 57 of the channel 56 and into the front wall 52, with the lower edge of flange 57 substantially flush with the edge of opening 53 through the front wall 52.

A bottom channel member 58 is secured to the bottom edge of front wall 52 by means of a plurality of screws or the like S extended through one upturned flange 59 of the bottom channel member and into the front wall 52.

A front cover plate 60 is secured to the outer flanges or sides 61 and 62 of the upper and lower channel members 56 and 58, respectively, by means of a plurality of screws S extended through the cover plate 60 and into the flanges 61 and 62. Side walls 63 and 64 are suitably secured to the opposite ends of the housing 37 by means of a plurality of screws or the like S extended through outwardly directed flanges 65 and 66 on the opposite end walls 63 and 64, respectively, and into the frame F. The end walls 63 and 64 have horizontally bent portions 67 and 68, respectively, extending inwardly into mating engagement with the opposite ends of the upper channel member 56.

The rollers 29 have reduced diameter opposite end portions 69 suitably journalled in bearing means or the like 70 in openings in the bracket 38 at opposite ends of the rollers, and at one of their ends the rollers have a further reduced diameter end portion or shaft 71 extending coaxially therefrom and through a suitable bearing means 72 in the rear wall 44 of the frame or housing 37, and a suitable driven gear means or toothed pulley 73 is fixed to and carried by the shaft 71 spaced between the rear wall 44 and the partition or intermediate wall 48.

A drive gear 74 is also suitably rotatably supported in the space between rear wall 44 and partition or intermediate wall 48 in offset relationship to driven gear 73 for the rollers 29. A roller drive gear 76 is connected with drive gear 74 by means of a shaft 75 for rotation therewith and the roller drive gear 76 is disposed in substantially the same plane as the gear 73.

An idler gear 77 is suitably rotatably supported in the space between rear wall 44 and intermediate wall 48 by means of a shaft 78 journalled in said walls and the idler gear 77 is in substantial vertical alignment with the endmost roller drive gear 73 at the left-hand end of the housing, as viewed in FIG. 5.

A suitable drive belt 79 is disposed around the drive gear 76 and around idler gear 77 and across the upper sides of roller drive gears 73, whereby motion imparted to the roller drive gear 76 is imparted to the rollers 29. A drive belt 80 is disposed around gear 74 and is operatively connected with a suitable source of power, such as a motor or the like (not shown) to impart rotation to the roller drive gear 76 and thus to the gears 73 and rollers 29.

In this regard, and referring particularly to FIG. 10, only the lower set of rollers 29*a*, 29*c*, 29*e* and 29*g* are connected to be driven by the belt 79, and the upper set of rollers 29*b*, 29*d*, 29*f* and 29*h* are driven by gear engagement with the lower rollers 29*g* and 29*c* and are supported by a yieldable means 81 to enable slight vertical movement of the upper rollers relative to the lower rollers to accommodate different thicknesses of material fed between the rollers and also to provide a release in the event the sheet of material becomes folded or jammed between the upper and lower rollers.

A deflector drive input gear 82 is suitably rotatably supported between the front wall 52 and the front plate 60 by means of a shaft or axle 83 journalled at its opposite ends in said walls by suitable bearing means (not shown), and a deflector drive output gear 84 is connected to the axle or shaft 83 for rotation therewith. A drive belt 85 is disposed around deflector drive input gear 82 and is connected with a suitable motive power means (not shown) to impart rotation to the input gear 82 and thus to the output gear 84. A plurality of substantially similar, coplanar deflector drive gears 86 are carried by shafts 87 rotatably journalled in bearings 88 and 89 in front wall 52 and front plate or cover plate 60, respectively, in aligned coplanar relationship with the gear 84, and a drive belt 90 is disposed around the gear 84 and the gears 86 for imparting rotation to the gears 86 when the motive means is operated to rotate the input gear 82.

Synchronization and control of the deflectors is effected through an operating means connected between the drive gears 86 and the deflectors. The operating means for the deflectors includes a conventional power transmission means such as spring clutch 91 or the like, or other suitable means, connected for rotation with the gears 86 and constructed to selectively transmit rotation of the gears 86 to an output shaft 92 extending through and journalled in the front wall 52 of housing or frame 37. The spring clutch includes a stop or detent rib 93 on the outer surface thereof and a substantially C-shaped holding means or clutch operating means 94 is pivotally attached to the frame or housing assembly 37 by means of a pivot pin 95 extended through a lateral extension 96 on one side of the holding means 94, and the opposite ends or surfaces 97 and 98 of the holding means 94 are arranged to alternately engage the rib 93 to stop rotation of the spring clutch and thus stop rotation of the output shaft 92. See FIGS. 5 and 15. A link 99 is attached to the holding means 94 and extends upwardly to a holding solenoid 100 mounted in the upper channel member 56, whereby upon energization of the holding solenoid 100 the link 99 is pulled upwardly, thus pivoting the holding member or means 94 upwardly, releasing the stop surface 97 from the rib 93 and permitting rotation of the spring clutch and output shaft 92 with the gear 86 through approximately 180° until the rib comes into contact with the other stop surface 98 of the holding means 94, thereby stopping rotation of the output shaft 92. The device 91 could be stopped at other increments of rotation, if desired, and different holding means could be used.

Thus, by alternately energizing and deenergizing the holding solenoid 100, the holding means 94 is alternately raised and lowered to enable the stop surfaces 97 and 98 to alternately engage the detent or stop rib 93, and thus rotation of the output shaft 92 is limited to increments of 180°, said shaft only rotating when neither of the stop surfaces 97 and 98 is in contact with the rib 93.

A radially extending crank or link 101 is fixed to shaft 92 for rotation therewith in the space between front wall 52 and partition or intermediate wall 48 and an elongate link 102 is pivotally connected at one end thereof to the crank or link 101 by means of a pivot pin 103 and is pivotally connected at its other end to one plate or disc 104 of a slip clutch 105 by means of a pivot pin 106 connected with the plate 104 adjacent the periphery thereof. The plate 104 is rotatably supported on a reduced diameter end portion 107 of a shaft 108 rotatably journalled in the walls 48 and 44, and a second clutch plate or disc 109 is fixed on the shaft 108 for rotation therewith, and rotation of plate 104 is frictionally imparted to plate or disc 109 by means of a friction material or clutch disc 110 sandwiched between the plates 104 and 109. The plate 104 is urged into frictional engagement with clutch disc 110 by means of a coil spring or other suitable biasing means 111 disposed around the reduced diameter end portion 107 of shaft 108 and held on the shaft by means of a nut or the like 112.

The size and arrangement of the spring clutch, links and slip clutch is such that each rotation of the slip clutch 91 and shaft 92 through 180° imparts a reciprocatory motion to link 102 and the disc 104 of the slip clutch is caused to oscillate back and forth through an angle of about 45° (see FIGS. 3 and 4).

The disc 104 has a pair of spaced notches 113 and 114 therein spaced a predetermined distance from the pivot pin 106 and angularly spaced apart approximately 22.5°. The disc 109 has a series of notches 115, 116, etc. in the periphery thereof. The notches 113 and 114 define a cam lobe 117 therebetween and an indexing latch mechanism 118 is operatively positioned to cooperate with the notches in the discs 104 and 109 to index the discs together and to latch the disc or plate 109 in its two limits of travel, as determined by the throw of links 101 and 102. The latch mechanism 118 includes a shaft 119 supported from the intermediate wall 48 and extending adjacent and beyond the periphery of the slip clutch 105 parallel to the axis thereof and a link 120 is pivoted at one end to the outer end of shaft 119 and carries a latch pin 121 at its other end extending parallel to shaft 119 and across the periphery of slip clutch 105. A coil spring or other suitable biasing means 122 is wound around the shaft 119 and has one end 123 thereof engaged with the wall 48 and the other end 124 thereof engaged with the latch pin 121 to urge the latch pin downwardly into engagement with the periphery of the slip clutch 105. The series of notches 115, 116, etc. in the periphery of the plate or disc 109 enables the disc to be quickly and easily indexed relative to the drive gears and position of the deflectors.

Accordingly, when the slip clutch is in one of its operative positions, as seen in FIG. 3 for example, which shows the deflector in its position for bypassing one of the fold pockets, the pin is engaged in the notch 113 of disc 104 and in one of the notches 115, 116, etc. in the periphery of the plate or disc 109, and when the links 101 and 102 are in their other operative position, as seen in FIG. 4, wherein the deflector is shown in its fold position, the latch pin 121 is disposed in the other notch 114 in the disc 104 and in one of the notches 115, 116, etc. in the disc 109, to latch the deflector in this position. In FIg. 4*a*, the action of the cam lobe 117 is seen, wherein as the disc 104 is caused to rotate the pin 121 rides upwardly out of the notch 113 or 114 and onto the cam lobe 117 and thus out of notches 115, 116, etc. in disc 109 to permit the frictional engagement of clutch disc 110 between discs 104 and 109 to rotate disc 109 and thus the deflector.

Each deflector includes a paper guiding surface 125 having opposite side edges 126 and 127 and a web or flange 128 projecting laterally from the side of deflector opposite the paper guiding surface 125. The deflector is mounted for pivotal movement about the side edge 126 by means of a pivot pin or the like 129 pivotally mounted in the rear wall 42 of bracket 38. A link 130 is carried by the shaft 108 connected with the slip clutch and has a bifurcated end 131 which receives a pin 132 carried by the edge of web or flange 128, whereby pivotal movement of shaft 108 and link 130 causes corresponding pivotal movement of the deflector about the side edge 126 thereof. The pin 132 extends through an arcuate slot 133 in the wall 42 and defines positive limits of travel for the deflector.

As seen best in FIG. 10, when the deflectors are at one of their limits of travel, as seen for example in full lines at deflector 31*a*, the side edge 127 thereof is engaged against one of the plates 33*a* of fold station 25*a*, and the paper guiding surface 125 defines an angular lead-in surface for the sheet of paper P to the fold pocket 32*a*, while when the deflector is in its other limit of travel, as seen in full lines at 31*b*, for example, the paper guiding surface 125 deflects a sheet of paper being fed between rolls 29*b* and 29*c* into the space betwen rolls 29*d* and 29*c*, which grip the leading edge of the paper and feed it to the next fold station in bypassing relation to the fold plate or station 25*b*.

With the structure as thus described, it is not necessary to accurately index each of the deflectors relative to the operating means therefor, since when the spring clutch 91 operates to rotate link 101 and impart reciprocal movement to link 102 and thus cause oscillatory movement of the slip clutch 105 and shaft 108, if the deflector is not properly indexed relative to the position of the spring clutch detent 93, the pin 132 will engage one end or the other of slot 133 and stop movement of the deflector, while the slip clutch will enable the operating means to continue operating to its full limit of travel, thus automatically indexing the operating means to the position of the deflector, and subsequent operations of the operating means will result in accurate and corresponding movement of the deflector.

Moreover, the use of the particular operating means as described, including the spring clutch 91 and holding means 94, 99 and 100, results in much faster operation of the deflectors, thus enabling a greater number of folds to be performed in a shorter amount of time, with resultant savings in time and money.

Moreover, the use of the solenoids 100 merely as a holding means for the synchronizing assembly for the deflectors results in less power requirement for the operating means for the deflectors and the drive for the deflectors can be effectively provided through the gear or toothed pulley and belt arrangement, as described.

In operation, the machine is turned on to energize the motors and drive the roller input gear 74 and thus drive the roller drive gears 73 and rollers 29, and the deflector input gear 82 and spring clutches 91, and slip clutches 105 and deflectors 31*a–f*. Initially, all of the deflectors are set in a first, deflect position with their paper guiding surfaces 125 substantially normal to the plane of the respective pockets and extending across the entrance thereto to deflect a sheet of paper past the respective fold stations, although the deflectors could be initially positioned in a fold position, with their paper guiding surfaces angularly disposed to guide a sheet of paper or the like into the respective fold stations, if desired. A sheet of paper or other material to be folded is placed on the infeed table T and if the dimensions of the paper are such as to be sensed by both of the sensing devices A and B, the deflector 31*a* at the first fold station is operated to a second, fold position, as seen in FIG. 2 and in FIG. 11B. This is achieved by a suitable circuit, to be later described, connected with the sensing devices A and B and with the holding solenoids 100, so that when the sensing devices A and B sense the presence of the sheet of paper or other material, the first holding solenoid 100 at the first fold station 25*a* is energized to release the spring clutch and enable rotation of the link 101 through 180° to thus rotate the slip clutch 105 and the link 130 through approximately 45° to thus rotate the deflector about its one edge 126.

Figure 11A:
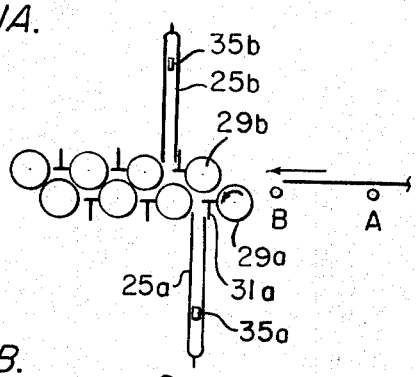
Figure 11B:
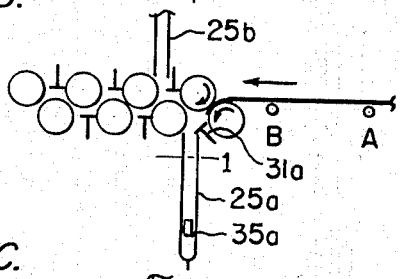
Figure 11C:
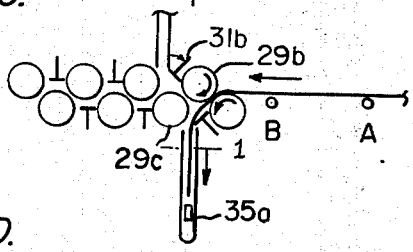
Figure 11D:
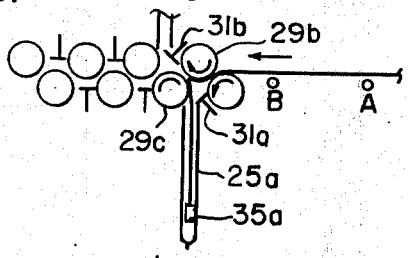
Figure 11E:
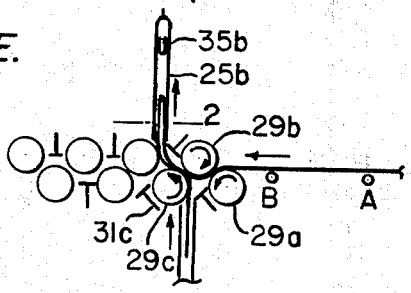
Figure 11F:
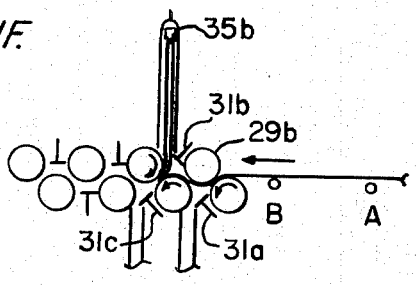
Figure 11G:
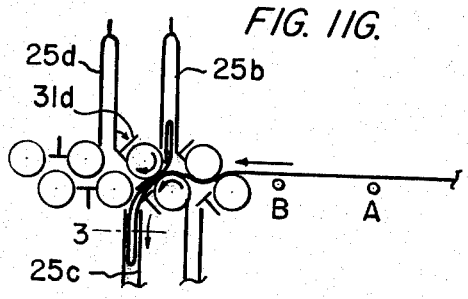
Figure 11H:
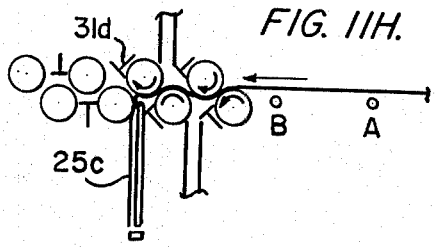
Figure 11I:
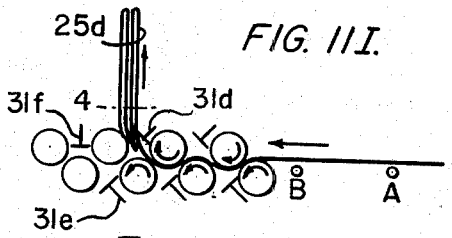

When the leading edge of the paper or other material enters the first fold pocket 32*a* and is sensed by the first sensing device 1 at that fold station, the next deflector 31*b* is operated to its fold position, as seen in FIG. 2 and FIG. 11C, if the sheet of paper is still sensed by both of the sensing devices A and B on the infeed table T. The paper continues to be fed into the fold pocket 32*a* until the leading edge thereof engages the stop means 35*a* and the paper or other material then buckles and is fed between the rollers 29*b* and 29*c*, as seen in FIG. 11D. The folded sheet of material is then fed into the fold pocket 32*b* and when the leading edge thereof is sensed by the sensing device 2 at fold station 25*b*, the next deflector 31*c* at fold station 25*c* is operated to the fold position, as seen in phantom line in FIG. 2, and in FIG. 11E. This operation continues with each succeeding deflector being operated to its fold position as soon as the leading edge of the paper being folded is sensed by the sensing device at the preceding fold station and so long as the sensing devices A and B both sense the presence of a sheet of material on the infeed table T.

Figure 11J:
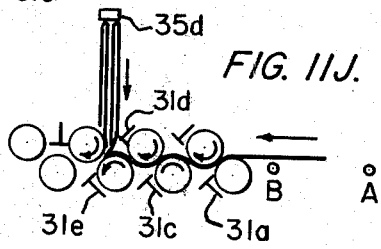
Figure 11K:
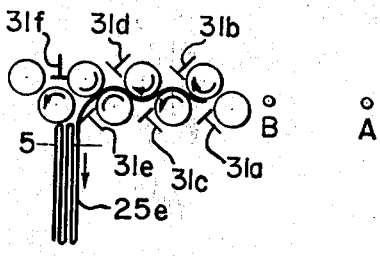
Figure 11L:
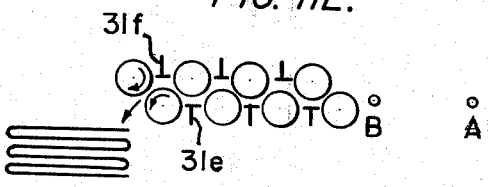

When the trailing edge of the paper or other material moves past sensing device A, as in FIG. 11J, the deflectors in advance of the sheet of paper are no longer operated to their fold position and the paper moves past those fold stations and is fed from the machine in folded condition, as in FIGS. 11K and 11L.

In FIGS. 12–14, a modification of the invention is shown and is substantially the same as the form of the invention previously described, except rather than the link 130 and pin 132, a pair of meshed gears 134 and 135 are provided for effecting oscillation of the deflectors. One of the gears 134 is carried by shaft 108 driven by the slip clutch 105 and the other gear is carried on a shaft 136 which is journalled in the back wall 42 and which is rigidly connected to the edge 126 of one of the deflectors 31*a–f* to effect rotation or pivotal movement of the deflector about the axis of shaft 136. A pin 137 is affixed to the flange 128 of the deflector and extends through the slot 133 to define positive limits of travel of the deflector. The deflector is self-indexing in this form of the invention, just as in the previously described form of the invention, and it is not necessary to accurately mesh the gears with the deflector in a predetermined angular orientation, since upon operation of the slip clutch and the gears, the deflector will be pivoted or rotated until the pin engages the end of the slot, and the deflector motion will then be stopped while the drive means will continue to operate with the clutch providing the necessary slippage until the limit of travel of the slip clutch is reached, and at this point the position of the deflector is properly indexed relative to the operating mechanism.

In FIG. 15, a still further modification is illustrated, and in this modification the holding solenoid 100′ and link 99′ are disposed beneath the spring clutches 91 and the link 99′ is much shorter. Otherwise the operation is identical to that previously described.

In FIG. 16 yet a further modification is disclosed, wherein a cam wheel 138 is mounted beneath the holding means 94 and has a recess 139 therein for cooperation with a pin or projection 140 carried by the holding means 94 to effect operation of the holding means. Suitable drive means (not shown) is connected with the cam wheel 138 to impart rotation thereto in response to the sensing devices A, B and 1–5. Otherwise, the operation of this form of the invention is also the same as that previously described.

In FIG. 17, a still further modification is shown, and in this form of the invention the slip clutch 105 is manually operated by means of a hand crank 141 and a handle 142, which are suitably pivotally mounted on the frame or housing 37 and connected through a shaft 143 to rotate a crank or link 144 back and forth through approximately 180° to thus impart substantially reciprocatory motion to an elongate link 145, which is connected to the plate or disc 104 of slip clutch 105 by means of a pin 106 to impart rotation to the slip clutch and operation of the deflector operating mechanism, as described before. The only difference between this form of the invention and those previously described is that operation of the deflector is manually controlled by means of the handle and crank 141 and 142.

With the apparatus as described, including six fold stations and six deflectors operatively arranged at the fold stations, and with the space between sensing devices A and B set at about 13 inches and with the sensing devices 1, 2, 3, 4 and 5 at the fold stations set approximately 3 inches from the open end of each fold pocket, sheets of paper or other material 77 inches in length can be easily, quickly and automatically folded to a standard dimension of 11 inches. Further, any size sheet may be fed into the machine of the present invention and automatically folded to a standard 11 inch dimension, with the settings as described above, since the sensing devices will automatically operate the deflectors to impart the required number of folds to the sheet to reduce it to the 11 inch dimension. If the sheet is not at least 13 inches in length to begin with, then none of the deflectors will be operated, since the sheet will not cover both of the sensing devices A and B at the same time, and the initial deflector 31*a* will not be operated and the sheet will, accordingly, be passed through the machine unfolded. Any suitable circuit means may be employed connected with the sensing devices and with the holding solenoids for the holding means on the control system or operating means for the deflectors, so long as the operation is obtained as described herein.

Moreover, while gears or pulleys and notched or ribbed belts have been disclosed and described for the drive means of the present invention, other suitable drive means may be employed, such as belts or chains and sprockets and the like.

A still further modification of the invention is illustrated in FIGS. 18 and 19, and in this form of the invention the basic operation of the device is substantially the same as that previously described. The housing 37' is slightly modified, in that a second intermediate partition or wall 47' is interposed between the front wall 51 and first intermediate partition or wall 47 and the solenoids 100 are supported in an inverted, channel-shaped bracket or plate 56', which is secured in substantially flush relationship with the upper surface of the housing 37' and the bottom edge of the front plate 60 is maintained in properly spaced relationship to the front wall 51 by means of a plurality of elongate spacers 146 interposed between the bottom edge of the front plate and the bottom edge portion of the front wall 51. Moreover, the drive rollers and pinch rolls are operated by means of a motor M, which drives a belt 147 and a roller drive gear 148 at the right-hand side of the machine, as viewed in FIG. 18, for example, and the shaft 69 of the rollers is extended at 69' through the housing 37' and is journalled at its end in the front plate 60 and has a suitable gear pulley or the like 149 secured thereon and a drive belt 150 is disposed around the gear 149 and around a gear 151 connected to the spring clutch 91, whereby the motive force for the spring clutch and thus for the deflectors is taken from the drive means for the rollers. In all other respects, the sequence of operation and the performance of the invention is the same as that previously described.

The electrical circuit for control of the operation of the deflectors is schematically illustrated in FIG. 20. At the top of the figure, a series of photocells or phototransistors A, B and 1–5 are shown, and these photocells or phototransistors are the sensing devices in the machine. Thus, phototransistors A and B are on the infeed table, and phototransistors 1–5 are disposed at the respective fold stations. Phototransistor A is connected through a buffer amp 1 with a logic network LN1, such as a CD4001 logic diode, and through a suitable transistorized amplifier circuit with the coil of solenoid S1 at the first fold station. Solenoid S1 is also connected with a pulse stretching network PS at the left-hand side of the figure, and including capacitor C1 and transistor Q9. The logic is positive, and a negative going voltage at the output of the phototransistors indicates the arrival of paper intersecting that phototransistor or photocell. Thus, when the phototransistor A is interrupted by a sheet of paper placed on the infeed table, a signal is sent through the pulse stretching network PS to trigger the power transistor Q9 to the non-conducting state, and this places all of the deflectors in the deflect position. The logic networks or diodes LN1, LN2, etc. require two signals in order to trigger the deflector associated therewith. Thus, both A and B must be covered to produce continuing folding through the machine, and as soon as A is unblocked or is no longer intersected by the paper, no further operation of any of the deflectors can occur. Accordingly, looking at FIG. 20, and assuming that phototransistor A is intersected by a sheet of paper being fed to the machine, a signal is produced through power transistor Q9, as described above, to operate all of the solenoids S1–S6 to move the deflectors associated therewith to the deflect position. When the sheet of paper advances and intersects phototransistor B, a signal is also produced and is conducted through buffer amp 2 to logic network LN1 to invert the signal and thus energize the solenoid S1 to operate the deflector at fold station 1 to the fold position to effect a fold in the sheet of paper. Assuming that the sheet of paper is long enough to still intersect phototransistors A and B, and to also intersect phototransistor 1 at the first fold station, the signal produced at the output of phototransistor A is fed to logic network LN2 and the signal at the output of phototransistor 1 is also fed to the logic network LN2 to thus produce a signal to the solenoid S2 for the second deflector and thus operate that deflector to its fold position. The operation as thus described continues with each successive solenoid and its associated deflector being operated so long as the phototransistor A is intersected by the trailing edge or portion of the sheet of paper. However, as soon as the trailing edge of the sheet of paper passes phototransistor A and phototransistor A is no longer interrupted, only one signal is conducted to the remaining logic networks and the solenoids associated therewith are, therefore, not operated.

Variations may be made in the circuit, and satisfactory operation of the machine still obtained. For example, the deflectors could be initially set to the fold position rather than to the deflect position, if desired, and the circuit modified such that sensing of certain sizes of paper would effect movement of the deflectors to the deflect position. Also, the number one fold plate or deflector at fold station 1 could be placed permanently in the fold position and the B photocell or phototransistor could be located in that fold station. This would only be used in the situation where all the paper that is fed through the machine is folded at least once.

A machine in accordance with the invention may be made more economically than prior art devices and is quicker and more efficient in operation than prior art devices.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

I claim:

1. A buckle-folding machine for folding sheets of material, comprising a plurality of fold stations each including a pair of pinch rolls and a fold plate defining a sheet-receiving space, infeed means to feed a sheet of material to the fold stations, deflector means at the fold stations operable to one position to cause the sheet to be fed between the pinch rolls and folded and operable to another position to deflect the sheet past the pinch rolls unfolded, dependent upon the dimensions of the sheet, and deflector operating means connected with the deflector means to operate the deflector means to their two positions, said operating means including a plurality of spaced apart first sensing means at the infeed means operatively connected to initiate operation of the deflector means at the first of said plurality of fold stations to effect folding of the sheet at said first fold station when said sheet exceeds a predetermined size as sensed by said first sensing means, and fold station sensing means at each of said fold stations, control means connecting said fold station sensing means together so that one fold station sensing means is operatively connected to a succeeding fold station sensing means at a next succeeding fold station to initiate operation of the deflector means at the next succeeding fold station into said one position to cause the sheet to be fed between the pinch rolls at said next succeeding fold station to further fold the sheet when the presence of the sheet is simultaneously sensed by the first sensing means at the infeed means and by said one fold station sensing means.

2. A machine as in claim 1, wherein the first sensing means comprises a pair of sensing devices spaced apart a predetermined distance in the direction of feed of the sheet of material, and the fold station sensing means comprises a sensing means at each fold station spaced a predetermined distance from the pinch rolls of that fold station.

3. A machine as in claim 2, wherein each fold station includes a pair of fold plates defining a fold pocket therebetween having an entrance thereto, the entrance to said fold pockets spaced closely adjacent the pair of pinch rolls for that fold station, said fold station sensing device spaced a predetermined distance inwardly of the entrance to the fold pocket, and said deflector means comprises a movable gate positioned at the entrance to the fold pocket and having a sheet guide surface to guide a sheet of material fed to the fold station, said deflector having a first, deflect position with the guide surface thereof across the entrance to the fold pocket to deflect the sheet past the fold pocket unfolded and a second, fold position with the guide surface angularly disposed and leading to the entrance to the fold pocket to guide a sheet of material into the fold pocket.

4. A machine as in claim 3, wherein a stop means is in each fold pocket against which the leading edge of the sheet abuts when guided into the pocket to cause the sheet to buckle adjacent the entrance to the fold pocket, said buckled portion of the sheet thus being fed between a pair of subsequent pinch rolls to effect folding of the sheet.

5. A machine as in claim 3, wherein electrical circuit means is connected with the first and fold station sensing means and deflector means to control operation of the deflector means in response to a condition sensed by the sensing means, said sensing means comprising photocells each having an output, and said circuit means comprising an amplifier means for amplifying said photocell outputs connected with the output of each of the photocells on the infeed means, the outputs of said amplifier means connected with a logic network, the output of said logic network connected through an amplifying circuit to a solenoid, and said solenoid connected to operate the deflector means at the first fold station upon energization of said solenoid, a pulse stretching circuit means for extending the amplified photocell output connected between the output of the amplified means of the first photocell on the infeed means and the solenoid for the deflector means at the first fold station, and the photocells at each fold station connected through a respective logic network and amplifying circuit means with a deflector means operating solenoid at each fold station, the output from the amplifier means of said first photocell connected as an input to each of the logic networks for the remaining photocells, and the output of the pulse stretching circuit means connected with each of the solenoids, whereby when the first photocell is interrrupted by a sheet of paper a signal is transmitted through the pulse stretching network to each of the solenoids to cause operation of all of the deflector means to one of said first and second positions, and when the sheet of paper interrupts both the photocells on the infeed means, two signals are transmitted to the logic network associated therewith to cause a signal to the first solenoid to operate the first solenoid and its associated deflector means to the other of said first and second positions, and when the photocell at each succeeding fold station is interrupted by the sheet of paper, a signal is transmitted through the logic network associated therewith to cause operation of the solenoid and deflector means at that fold station to said other position so long as the first photocell remains interrupted by the first sheet of paper.

6. A machine as in claim 1, wherein the sensing means comprise photocells.

7. A machine as in claim 1, wherein each fold station includes a pair of fold plates defining a fold pocket therebetween having an entrance thereto, the entrance to the fold pocket disposed adjacent the pinch rolls for that fold station, and the deflector means comprises a gate movably mounted adjacent the entrance to the fold pocket, said gate having a guide surface to guide the sheet of material and having a first position blocking the entrance to the fold pocket and a second position leading into the entrance to the fold pocket.

8. A machine as in claim 7, further including a friction clutch means for transmitting power from a power means to said deflector means and wherein said deflector operating means includes a rotatable spring clutch means for connecting said power means to said clutch means to cause rotation thereof, holding means engagable with said spring clutch means and selectively operable to two positions of engagement with the spring clutch means to stop rotation of the spring clutch means at said two positions, said two positions spaced approximately 180° apart so that said spring clutch means moves in increments of 180°, first link means connected with said spring clutch means for rotation therewith in said 180° increments for connecting said power means to said spring clutch means, and second link means connected with said first link means for transmitting oscillatory motion, said second link means connected with a first disc of said friction clutch means, said friction clutch means including a second disc and a friction material sandwiched between said first and second discs, whereby motion imparted to the first disc by the second link means is transmitted to the second disc, a shaft connected with the second disc and extending coaxially therefrom and connected with said deflector means, said second link causing said friction clutch means to oscillate back and forth and thus to effect oscillating movement of said deflector between its said two positions.

9. A machine as in claim 8, wherein a lever is connected at one end to said shaft and extends perpendicularly to said shaft, said lever connected at its other end to said deflector means.

10. A machine as in claim 8, wherein a toothed gear is carried by said shaft extending from said friction clutch means, and a second toothed gear is connected to said deflector means, said first and second gears being meshed with one another, whereby rotation of said shaft and first gear causes rotation of said second gear and said deflector means.

11. In a buckle-folding machine for folding sheets of material, the machine including infeed means to feed a sheet of material to the machine, a plurality of fold stations each having a pair of pinch rolls between which the sheets may be fed to be folded, deflector means at each fold station selectively operable to one position to deflect the sheet through the machine unfolded and to a second position to deflect the sheet between the pinch rolls to fold the sheet, and operating means connected between a source of power and the deflector means to operate said deflector means to the first and second positions, the improvement comprising a friction clutch means having a pair of engagable discs in the operating means operative to transmit power from a source of power to the deflector means in normal operation, but operative to slip and interrupt the transmittal of power in the event movement of the deflector means is hindered, to thus protect the operating means and deflector means and wherein the operating means includes first connecting means connecting said clutch means to the power source in a manner which causes said clutch to reciprocate, and second connecting means connecting said deflector means to said clutch means in a manner which causes the deflector to oscillate.

12. A machine as in claim 11, wherein sensing means are on the infeed means and at the fold stations to sense the presence of a sheet of material fed to the machine, said sensing means operatively connected to the deflector means to cause operation of the deflector means in response to the sensed presence of the sheet of material.

13. A machine as in claim 12, wherein said clutch deflector means includes a spring clutch and said operating means includes a belt engaged with said spring clutch to effect rotation of said spring clutch, said spring clutch having a stop rib on an outer surface thereof and an output shaft extending coaxially therefrom, a first link connected to the output shaft for rotation therewith, a holding means engagable with said stop rib on said spring clutch and operable to stop the stop rib in two positions spaced approximately 180° apart to effect rotation of the first link through 180° increments, a second link connected at one end with the first link and connected at its other end with the means, a solenoid connected with said holding means to operate the holding means, said solenoid being operatively connected with the sensing means so that said solenoid is energized responsive to the condition sensed by the sensing means to effect operation of said holding means and thus said incremental movement of said spring clutch and movement of the means to its two positions.

14. A machine as in claim 13, wherein the deflector means includes a substantially flat paper guiding surface adapted to be disposed across the path of a sheet of paper passing through the machine to deflect the sheet of paper and prevent it from entering between an associated pair of pinch rolls, a web extending substantially perpendicularly from the deflector on the side thereof opposite said paper guiding surface, said deflector mounted for pivotal movement about one edge of the paper guiding surface, an elongated deflector operating shaft secured to said one edge and extending longitudinally therefrom, a gear secured on the end of said shaft, said operating means including a rotatable shaft having a gear thereon in mesh with the gear on the deflector shaft, so that the deflectors can be removed and replaced in different positions thereof.

15. A machine as in claim 13, further including pinch rolls which include a plurality of upper pinch rolls and a cooperating plurality of lower pinch rolls, a reduced diameter shaft extending from opposite ends of the lower plurality of pinch rolls, a motor means connected with the shaft at one end of at least one of the lower plurality of pinch rolls to rotate the pinch roll, means interconnecting the plurality of pinch rolls whereby operation of said at least one pinch roll by said motor means results in operation of all the pinch rolls, the shaft extending from the other end of said at least one pinch roll being elongated and connected to the deflector operating means, drive means on the elongated end of said shaft, said deflector operating means including driven means connected with the drive means to be driven thereby, whereby the deflectors are operated by the pinch roll drive means.

* * * * *